US005738613A

United States Patent [19]

Clayton

[11] Patent Number: 5,738,613

[45] Date of Patent: Apr. 14, 1998

[54] DEVICE AND METHOD FOR EXERCISING THE MUSCLES OF THE FINGERS AND HAND USING WEIGHTS

[76] Inventor: Tom Clayton, 3412 Baywood, Nacogdoches, Tex. 75961

[21] Appl. No.: 598,321

[22] Filed: Feb. 8, 1996

Related U.S. Application Data

[63] Continuation-in-part of Ser. No. 284,141, Aug. 2, 1994, abandoned.

[51] Int. Cl.[6] ..... A63B 23/16

[52] U.S. Cl. ..... 482/47; 482/44; 482/48; 482/100; 482/102; 482/134

[58] Field of Search ..... 482/44, 47, 48, 482/134, 99–103

[56] References Cited

U.S. PATENT DOCUMENTS

| | | | |
|---|---|---|---|
| 494,197 | 3/1893 | Hall . | |
| 530,669 | 12/1894 | Strong . | |
| 623,592 | 4/1899 | Bonney | 482/48 |
| 802,026 | 10/1905 | Beall . | |
| 867,981 | 10/1907 | Krizek . | |
| 1,126,938 | 2/1915 | Barrett . | |
| 1,256,004 | 2/1918 | Finney . | |
| 1,301,560 | 4/1919 | Hill . | |
| 1,472,906 | 11/1923 | Gorrell . | |
| 1,707,151 | 3/1929 | Thomas . | |
| 3,019,019 | 1/1962 | Forte | 482/94 |
| 3,782,719 | 1/1974 | Kuhlman | 482/48 |
| 4,368,883 | 1/1983 | Tiktin . | |
| 4,455,019 | 6/1984 | Harris | 482/98 |
| 4,456,002 | 6/1984 | Barber et al. . | |
| 4,577,861 | 3/1986 | Bangerter et al. | 482/46 X |
| 4,615,522 | 10/1986 | Plough . | |
| 4,836,531 | 6/1989 | Niks | 482/44 |
| 5,072,934 | 12/1991 | Blanes | 482/904 X |
| 5,156,581 | 10/1992 | Chow . | |

FOREIGN PATENT DOCUMENTS

| | | | |
|---|---|---|---|
| 1250577 | 12/1960 | France | 482/48 |
| 1438402 | 4/1966 | France | 482/48 |

OTHER PUBLICATIONS adaptAbility, Products for Independent Living, Excerpts from Catalog, pp. 17, 34–39, 1993.

*Primary Examiner*—Richard J. Apley
*Assistant Examiner*—John Mulcahy
*Attorney, Agent, or Firm*—Larson & Taylor

[57] ABSTRACT

A device for training hand and finger muscles including a hand engaging element, a fixed weight and a mechanism for moving the weight in response to movement of a finger. The moving mechanism may include a rope connected to the weight and the hand engaging element, the weight being freely suspended from the rope. This device allows the resistance presented to fingers to be exercised to be varied in exact and reproducible amounts which are in an appropriate range for the fingers. The device also allows many positions of the fingers, both along and among the fingers, so that the exercises may be tailored for the individual and the task for which the fingers are being trained.

13 Claims, 7 Drawing Sheets

DEVICE AND METHOD FOR EXERCISING THE MUSCLES OF THE FINGERS AND HAND USING WEIGHTS

RELATED APPLICATIONS

This application is a continuation-in-part of U.S. Ser. No. 08/284,141, filed Aug. 2, 1994, and now abandoned.

FIELD OF THE INVENTION

This invention relates to exercise equipment, specifically to a device used as weights alone or weights with force redirectional devices, e.g., pulleys to train the muscles responsible for operating or moving the arms, hands and fingers.

BACKGROUND OF THE INVENTION

For centuries, people have desired to improve the strength, endurance, velocity and coordination of the finger muscles. Problems of ability to control fingers to move and perform according to the desired tasks at hand have been magnified by the increasing complexity of tasks technological improvements have placed on the human fingers.

Previous attempt to solve these problems have included constructing devices to forcibly maintain the independence of one finger by actively restricting the movement of others. Such devices are shown in U.S. Pat. No. 1,256,004 and U.S. Pat. No. 4,615,522. As the applied force by or on one finger increases, the other fingers and parts of the hand naturally try to aid in getting the task done. This is known as recruitment. This gives rise to muscular contractions elsewhere on the hand and arm that generate forces that are not translated into motion. Structures that are not an integral part of the motion mechanism of the finger being exercised may be subjected to oblique forces that they are not designed to handle under normal conditions, thus increasing the possibility of damage.

A few devices have been constructed for exercising fingers using resistances made of contractile materials like rubber bands or metal springs. Such devices are disclosed in U.S. Pat. No. 494,197, U.S. Pat. No. 623,592, and U.S. Pat. No. 1,790,934. As the muscle contracts, the resistance increases the more the band is stretched or the more the spring is depressed. This introduces a variation in the effort required by the person to do the exercise properly, as the end point of the contractile displacement is practically impossible to measure or accurately reproduce. Another problem with contractile materials is uniformity in manufacture.

U.S. Pat. No. 1,472,906 attempts to solve some of the problems mentioned above. The exercise device disclosed therein allows the fingers to move independently under contractile force, without forcibly restricting the movements of the other fingers. This device allows for more types of finger movements by fixing the bands to a frame that will exercise the fingers when they are being put down (flexion), lifted-up (extension) or moved sideways (laterally or abduction/adduction).

U.S. Pat. No. 3,782,719 and French Patent No. 1,438,402 disclose exercise devices which allow fingers to move independently. However, in order to exercise the fingers, the forearm must be strapped to a fixed-incline platform such that the palm can only face either upward or downward. Because the angle of the platform is less than 45 degrees and the platform cannot be adjusted vertically upward, the device also tends to create a strain on the shoulders as the amount of resistive force increases. This not only reduces the effectiveness of the exercise but also causes discomfort to the user.

Some patents have suggested using metal rings through which the fingers can be inserted. One problem with metal rings is the force of the resistance connected to the ring is focused on a very small portion of the ring, i.e., the part of the ring that is tangent to the finger at the point of contact. This concentrated or "point" force can damage the soft tissue of the finger.

Another device for exercising the fingers, called DIGI-FLEX®, is held in the hand and uses springs. Springs do not offer optimal resistance, since the force on the muscle is increasing at the same time the muscle fibers are shortening. This device does not allow the fingers to be exercised in the same types of positions required for many different tasks because it is held in the palm of the hand. DIGI-FLEX® dictates that the fingers be exercised in a very limited position.

Another type of exercise involves squeezing a ball multiple times. A squeezable ball has the same effect as the contractile material. The ball has to be small enough to be squeezed as it is held in the fingers and palm, which means that the angles of the fingers at the MP joint (the junction of the palm) are about 90° off of the position in which the fingers need to be placed for many of the types of exercises that mirror the specific task desired.

Hand grip devices primarily exercise the muscles responsible for wrist gripping and do little for the finger flexors. They do not individualize the fingers being exercised and ignore the extensors and small muscles of the palm that help move the fingers.

Contracting muscles are responsible for speed, strength (or force), endurance, and flexibility of the fingers and the hand. Therefore, the present invention focuses on the functional requirement of the muscles themselves, and what the muscles need on a physiological basis to be able to function optimally.

SUMMARY OF THE INVENTION

According to a preferred embodiment of the invention, a device for training hand and finger muscles includes a frame having at least one support member thereon and a resistance member. The resistance member is removably attached to the support member by attachment means, and includes a weight for providing a resistance, a cable or rope having a first end attached to the weight, and at least one finger engaging element attached to a second end of the cable or rope for moving the weight in response to movement of a finger. The device also includes support means for supporting an elbow or forearm of a user in a position in which the arm is close-in to the body during exercise of hand and finger muscles, thereby minimizing strain on muscles other than those of the fingers and hands and isolating these muscle groups from compensation-type actions of the larger muscles of the arm during exercise. The support means is adjustable between vertical and horizontal positions.

According to another preferred embodiment of the invention, a device for training hand and finger muscles has the structure of a box-shaped frame. The frame has a top, a bottom, a front, a back and two sides. At least the front is open such that a forearm of a user is insertable into an interior portion of the frame, thereby allowing forces to be applied to the fingers from many directions, including behind and below the position of the hand. The frame includes at least one support member having multiple connections at varying horizontal or vertical positions. The device also includes a resistance member as described above and attachment means for removably attaching the resistance member to the support member at one of the multiple connections.

The amount of resistance provided by the weight means may, of course, be varied and the device may include a mechanism for preventing the weight means from being raised and/or lowered beyond a certain height.

In addition, either of the aforementioned embodiments may further include at least one pulley removably attached to the attachment means, the pulley being interposed between the weight and the finger engaging element. The pulleys may swivel for allowing at least two fingers of a user to individually exercise in a position in which a respective palm of a user is facing upward, downward or at any position therebetween such that said resistance members do not interfere with one another during rotation of a user's wrist.

According to a further aspect of the invention, the finger engaging element is a "soft" sling through which a finger is inserted. This "soft" sling is not so wide that it cannot fit between joints of the finger and can be made long enough to where it may receive more than one finger. A mechanism for clamping the soft sling to fit the finger may be provided.

According to a further aspect of the invention, multiple sets of weights and finger engaging elements may be provided for exercising more than one finger either at the same time, or in any sequence.

It is, therefore, an object of the present invention to provide a device which allows varying of the resistance presented to fingers to be exercised in exact and reproducible amounts which are in an appropriate range for the fingers.

It is a further object to provide a device which allows many positions of the fingers, both along and among the fingers, as well as differing positions of the forearm, rotated at the elbow, so that the exercises may be tailored for the individual and the task being trained for.

It is yet another object of the invention to provide a device for exercising hand and finger muscles which minimizes strain on muscles other than those of the fingers and hands during exercise, including utilizing the elbow as a stabilizing fulcrum.

Other objects, features, and advantages of the invention will be apparent from the following description of preferred embodiments.

BRIEF DESCRIPTION OF THE DRAWINGS

The invention will be described in further detail with reference to the accompanying drawings, wherein.

DETAILED DESCRIPTION OF THE INVENTION

The device of the present invention is designed to uniquely meet the needs of the fingers and hands by certain methods of adjustment and suspension that allow the device to be more adaptable to the needs of the person exercising. The muscles to be exercised include any muscle whose bulk is located entirely within the palm or hand, including the thenar and hypothenar muscles of the thumb and little finger and the interosseous and lumbrical muscles of the fingers, and finger muscles, including all flexion and extension groups of muscles, as well as any other muscle groups that help fingers perform any of a variety of activities. When using the device, it is generally not necessary to additionally stabilize the larger muscles of the arms and shoulders, as long as the elbow is properly stabilized. Virtually complete isolation of the finger and hand muscles is also possible as a direct result of the load itself being placed as specifically as possible only on the muscles responsible for variable precise movements of the fingers, which is a function of the load itself, the size of the load, the direction of the motion and the size and location of the muscle groups.

Figure 5:
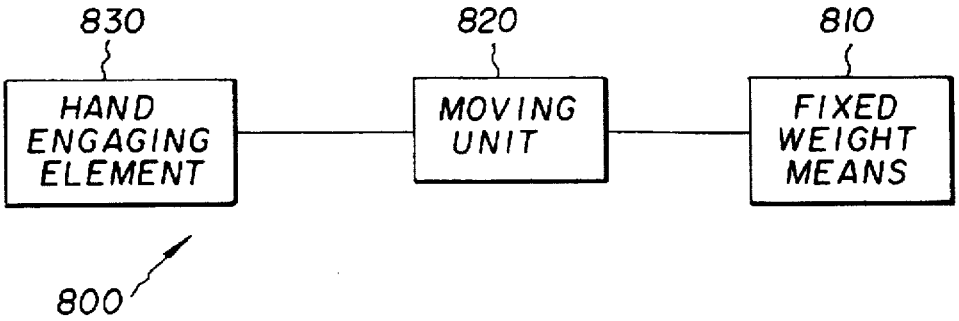
FIG. 5 is a block diagram of a general embodiment of the present invention.

An overview block diagram of a resistance member 800 of the device of the invention is shown in FIG. 5. Resistance member 800 generally includes a fixed weight means 810, an element 830 for engaging the hand to be exercised and a unit 820 for moving the weight means 810 in response to the movement of the hand engaging element 830. Weight means 810 presents the hand with a fixed resistance, in contrast to a variable resistance device, such as a spring or a rubber band. Use of fixed weight means 810 thus allows progress to be easily monitored, insures reproducibility of the exercise, and provides a direct and precise feedback as to the motivation and ability of the exerciser.

Figure 1A:
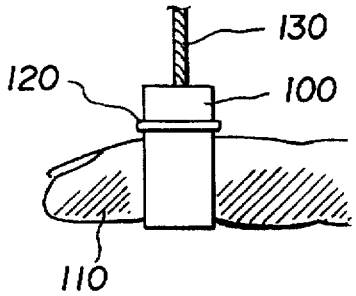
FIG. 1*a* illustrates a side view of a preferred embodiment of a sling of the invention.
Figure 1B:
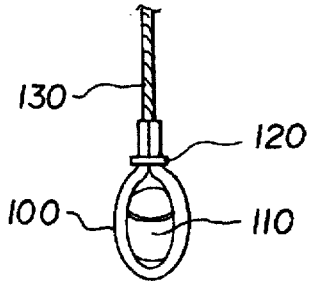
FIG. 1*b* illustrates a front view of a preferred embodiment of a sling of the invention.

Considering a preferred embodiment of the device in more detail, as shown in FIGS. 1*a* and 1*b*, the hand engaging means 830 is a sling 100 which receives a finger 110 to be exercised. Sling 100 is advantageously an open loop which is wide enough to fit between two finger joints in order to distribute the force on the finger over a wider cross-sectional area. Sling 100 may be placed between the MP (where the finger joins the palm) and PIP (the next distal joint after the MP joint) joints, the PIP and DIP (the last joint before the finger tip) joints, across a joint itself, or on the fingertip. This allows the resistance offered by the weight to be isolated to whichever muscles control the motion of the finger at the joint proximal to the location of sling 100. Since the force is transmitted via a tendon back to a muscle that is located away from the finger or the muscles in the palm that insert directly at the base of the finger (MP joint) without a tendon, there is no significant compromise in the training effect on the muscles by placing the sling on parts of the finger other than the fingertip. As long as the resistance is applied to the muscle anywhere distal to its attachment and before the next joint, that muscle will be exercised. Sling 100 may be large enough to receive more than one finger at a time.

Sling 100 may be made of any soft, pliable, strong material, such as cloth or leather. A clamping device 120 may be applied to adjustably fit finger 110. Sling 100 also includes a connecting portion 130 which acts as the moving unit 820 allowing sling 100 to be attached to fixed weight means 810.

Figure 2A:
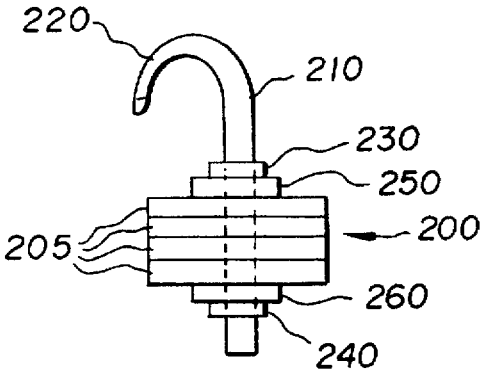
FIG. 2*a* illustrates a side view of the preferred embodiment of an adjustable weight of the invention.
Figure 2B:
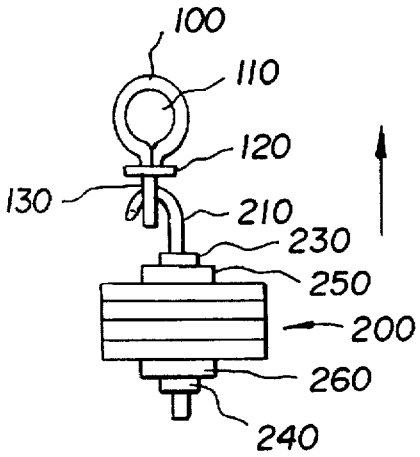
FIG. 2*b* illustrates a preferred embodiment of the invention for exercising the flexors.

FIG. 2*a* shows the fixed weight means 810 in the form of a fixed weight 200 placed on a rod 210 having an end 220 which may be used for attachment of the weight to the moving unit 820. End 220 is advantageously a hook or eyelet. Fixed weight 200 advantageously includes a variable number of weights 205 of small increments, e.g. one ounce, so that total weight may be varied by altering the number of weights 205. However, weight 200 may have any shape such as a solid cylinder, circular plate, and the like. Nuts 230, 240 limit the movement of the weights 205 and holding plates 250, 260 may be used to further secure weights 205. In order to exercise the extensors, fixed weight 200 merely needs to be attached to sling 100 by inserting hook 220 through attachment device 130 so that fixed weight 200 hangs freely below finger 100, as shown in FIG. 2*b*. Obviously, device 130 could alternatively be a hook and hook 220 could be an eyelet. In order to exercise the extensors of the finger 100, weight 200 must be moved upwards, as shown by the arrow in FIG. 2*b* indicating the direction of motion.

Figure 3B:
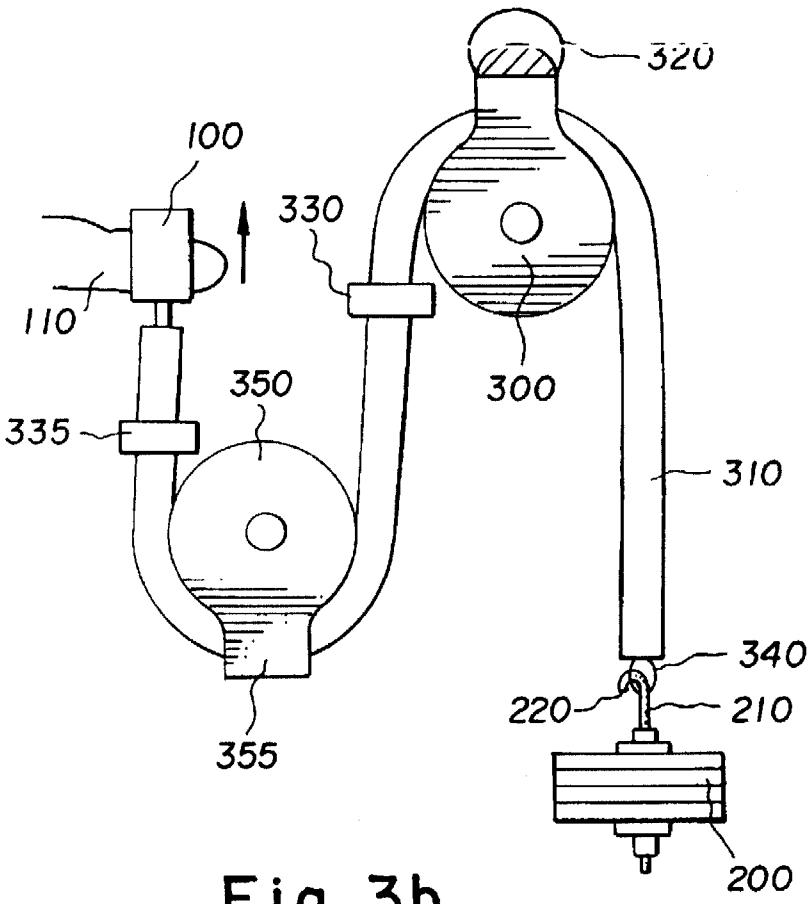
FIG. 3*b* illustrates another preferred embodiment of the invention for exercising the extensors.
Figure 3A:
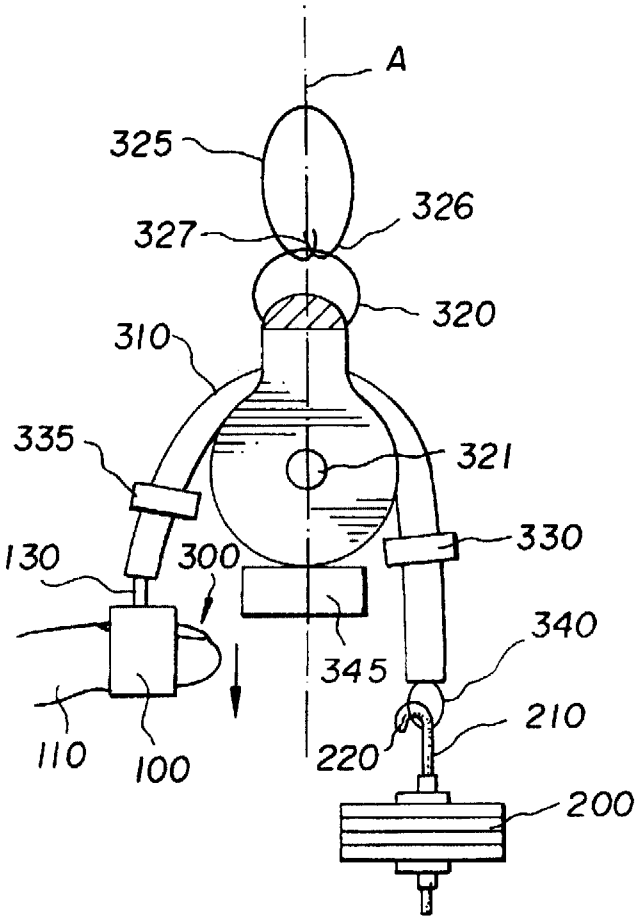
FIG. 3*a* illustrates a preferred embodiment of the invention for exercising the flexors.

As shown in FIG. 3*a*, a pulley 300 may be interposed between sling 100 and weight 200 in order to redirect the force so that greater weight can be applied to the fingers and hands without the bulk of the weight itself interfering with the motions of the fingers or body parts. These forces are transmitted through the moving unit 820 which is preferably a cable (or rope) 310 attached to the weight and focused on the body part to which the force is being applied by loop 100. Cable 310 is made of non-stretchable material. The pulley 300 allows the type of contraction to be dynamic and minimizes friction that would occur if the cable 310 were simply draped over a rod or other support. The fingers are then more free to assume any of the myriad of desired exercising positions.

Pulley 300 also guides the cable 310 and attached weight 200 and helps to minimize the undesirable motion which does not contribute to the excursion of the weight in the process of actually training the muscle, i.e., motion that is not in the same direction as the contracting muscle or the motion of the body part that the muscle is moving. Having a swivel attachment 320 on pulley 300 allows for the fingers to exercise in positions that are off the long axis of the forearm, i.e., fingers moving but not pointing straight ahead. In other words, the pulley 300 may rotatable about axis A.

Another advantage of using pulleys is that the positions and excursive distances of the weight can be changed in order to allow conservation of space for the actions of the muscles as they are trained throughout the range of motion. For example, in flexion exercises or in downward movements of the fingers, placing the pulleys higher than, the same level as, or lower than the body part being exercised allows the weight space that it needs so that it will not touch anything that might support the weight, thereby taking the force away from the muscle being exercised, as it goes up and down during the range of motion of the muscle contracting. This allows placement of the long axis of the cable in any position relative to the long axis of the finger or the part being exercised. The angle of the cable to the part being exercised may range between 0° and 180°. There is mechanical advantage to be gained by being able to vary the force factor relative to the axis of the body part.

The actual excursion and position of the weight relative to the range of motion of the finger may advantageously be adjusted by a gripping device 330 that is present on the cable itself. This gripping device can easily be slid along cable 310 and secured by releasing the spring loaded tab so that it "locks" onto cable 310. This gripping device 330 serves as a break for this part of cable 310 when cable 310 arrives at the eye of pulley 300. This allows a greater degree of freedom of the position of the fingers and the person relative to the exercise device, since the ranges of motion in these types of exercises are generally short. By changing the rest position of the weight relative to the floor or table top and the pulley, an individual can adopt the device to more restrictive space environments. An additional gripping device 335 may be placed on rope 310 on the same side as sling 100 so as to limit how low weight 200 may fall.

A cable 325 (which may be padded) having hooked ends 326 and 327 may be used to suspend pulley 300. Both hooked ends 326, 327 may be hooked to pulley 300, forming a loop to be looped over or through a support. Alternatively, only one hooked end may be hooked to pulley 300, leaving the other hooked end to be used for hooking onto a support.

A conventional counter 345 may also be provided. This counter 345 may be electrical, mechanical or magnetic. The counter 345 may be used to count a number of repetitions and/or whether a desired range of motion has been achieved. The counter can be set to where it emits an audible signal or shows a display when and each time a number of group of movements occur, e.g. every five or ten contractions, instead of every one. Such a setting is advantageous since the number of repetitions is often much greater than in exercisers with large muscle groups. An exercise in one direction, particularly when improving endurance (smaller weight, more repetitions) may involve thirty to fifty repetitions. The counter 345 may make these determinations by monitoring the position of stop 330 or 335, or by counting the number of rotations of pulley 300. When a number of repetitions is to be monitored, counter 345 advantageously includes a visual display of the counted number. When the attainment of a desired range of motion is to be monitored, counter 345 advantageously emits an audio tone when the desired range has been reached.

In order to perform extension or upwards exercises using pulleys, an additional pulley is included, as shown in FIG. 3*b*. When pulleys 300, 350 are placed below the fingers, allowing the movement of the fingers in the upwards direction or towards the top of the forearm, the extensors are placed under a load by the direct application of the sling and weight shown in FIG. 2*b*. The top 320 of pulley 300 and the bottom 355 of pulley 350 may be secured to a support.

Figure 4B:
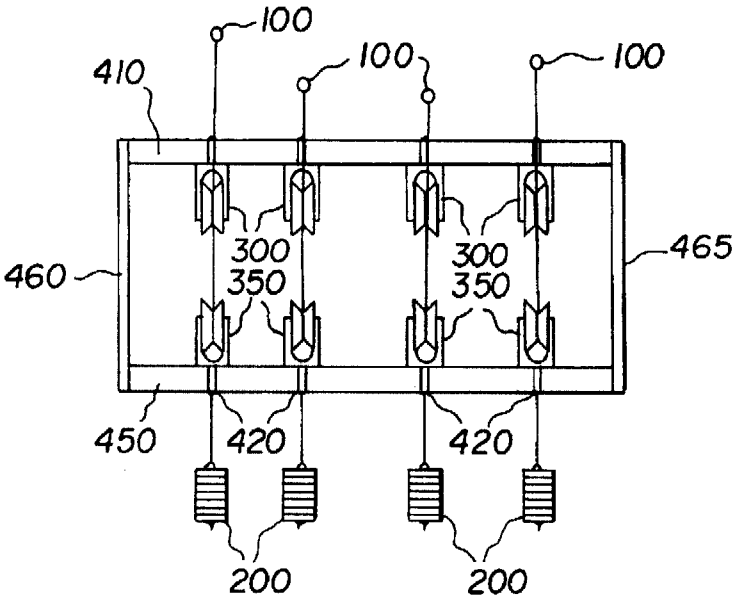
FIG. 4*b* illustrates a preferred embodiment of a support for multiple sets of the device of FIG. 3*b;*
Figure 4A:
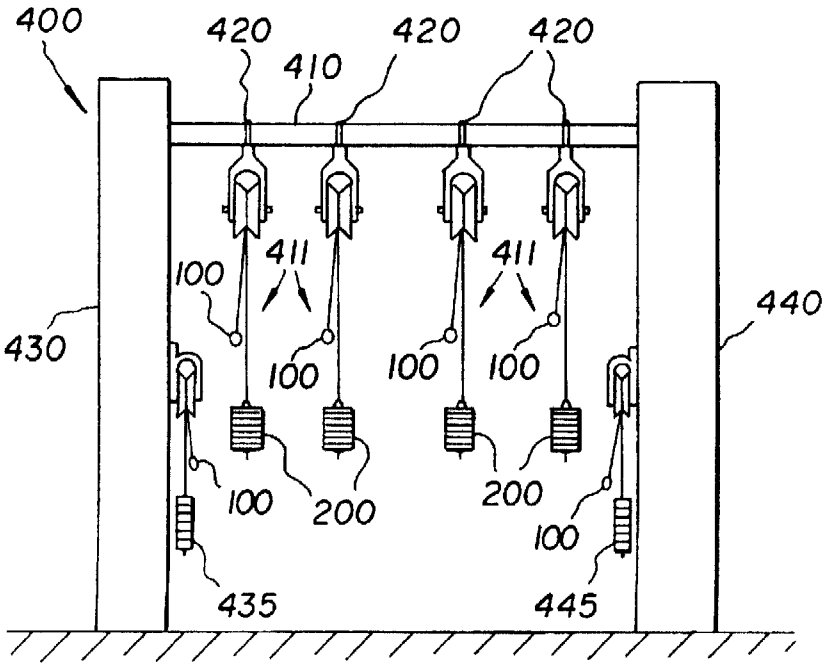
FIG. 4*a* illustrates a preferred embodiment of a support for multiple sets of the device of FIG. 3*a;*

FIG. 4*a* and 4*b* show the use of multiple sets of pulleys, slings and weights attached to a simple frame. Such a configuration allows all of the fingers to be exercised simultaneously or sequentially without having to take a sling on and off or change the required weight. Such a multiple arrangement may have any desired number of sets. One of the following configurations is typically most desirable: four sets, one for each finger, five sets, one for each finger and the corresponding thumb; and six sets, one for each finger and both thumbs. Preferably, the pulleys are of the swivel-type, as discussed in connection with FIG. 3*a*, so that the palm of the user can be rotated from an upward or downward position to a sideways position without the cables (or ropes) crossing.

FIG. 4*a* shows a front view of multiple sets of the device used to exercise the flexors as shown in FIG. 3*a*. A frame 400 may be made out of any material, such a wood, metal, or plastic, as long as the material is strong and rigid enough to support the multiple sets. Sets of resistance means 411 for exercising the fingers are secured by any known means, such as a clamps 420, along the top vertical bar 410 of frame 400. Preferably, the individual resistance means 411 are releasably secured so that the position of the sets may be adjusted for different users and/or different exercising positions. A resistance means 435 or 445 for exercising the thumb on the same hand of the fingers to be exercised is advantageously releasably secured on one of the horizontal posts, 430 or 440 respectively, of frame 400. The other resistance means 445 or 435 for exercising the thumb of the non-exercised hand is releasably secured on the horizontal post 430 or 440 opposite the other thumb set. These resistance means 435, 445 may also be provided along top support bar 410.

The weights 200 of the different resistance means 411, 435, 445 may be hung at differing heights in order to avoid collision thereof. The base of frame 400, which may be provided by horizontal posts 430, 440 alone, should have a sufficient surface area and be heavy enough so that the entire configuration is stable during use. Alternatively, the frame 400 may be secured to a flat surface as described below in connection with FIG. 9*a*.

FIG. 4*b* shows a front view of multiple sets of the device used to exercise the extensors as shown in FIG. 3*b*. Pulleys 300, 350 of each set are secured to the top vertical bar 410 and a bottom vertical bar 450, respectively. Sides 460, 465 can be used to releasable support weights similar to those supported on sides 430, 440 in FIG. 4*a*.

Figure 6A:
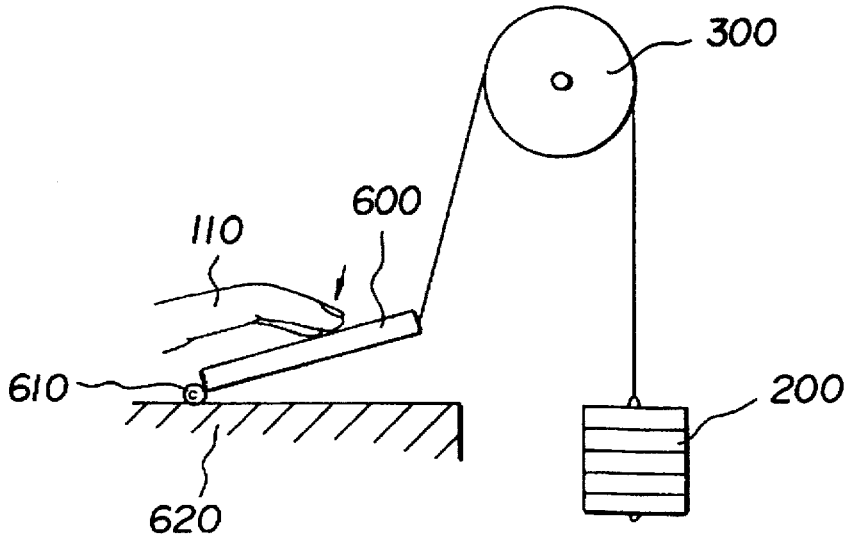
FIG. 6*a* illustrates an alternative to the soft sling for exercising the fingers.
Figure 6B:
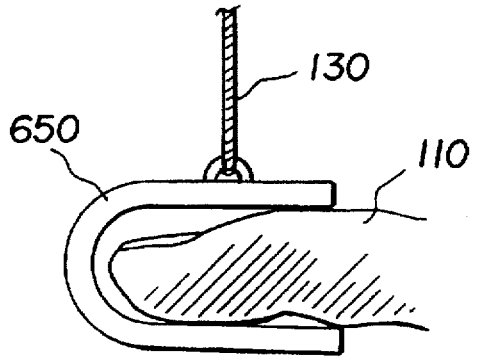
FIG. 6*b* illustrates another alternative to the soft sling for exercising the flexors.

FIGS. 6*a* and 6*b* illustrate alternatives to sling 100. In FIG. 6*a*, the flexors are exercised via fingertips using a key 600 attached by hinge 610 to a support 620. Hinge 610 may be placed anywhere along key 600. This configuration simulates the action of a piano key, but is capable of greater excursion for more of the range of motion of the muscle.

The FIG. 6*b* embodiment is also for exercises using the fingertip. A soft cup 650 keeps finger 100 from slipping out. Cup 650 may be used in conjunction with the device to exercise either flexors or extensors.

Figure 7A:
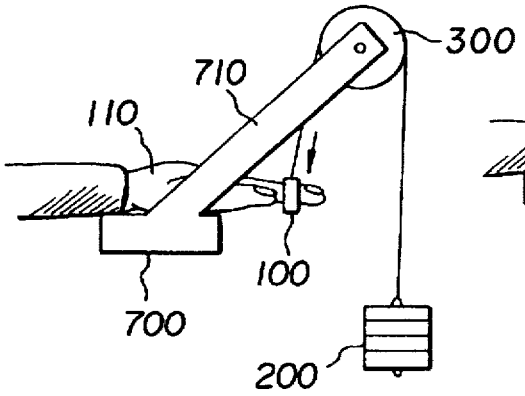
FIG. 7*a* illustrates a side view of a hand rest for use while exercising the fingers.

FIG. 7*a* shows a hand rest that may be used in connection with flexor exercises. The hand rest 700 simply provides a surface on which the palm is to remain during the exercises, thus helping the user to isolate the finger muscles. An attachment rod 710 may be used to attach hand rest 700 to frame 400 or directly to pulley 300 in the case of a single pulley device of FIG. 3*a*.

Figure 7B:
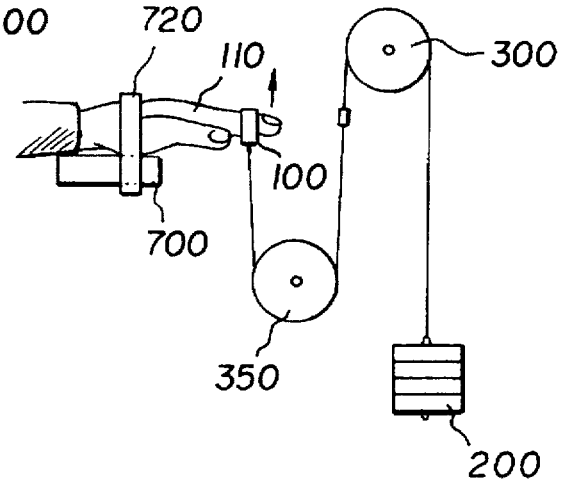
FIG. 7*b* illustrates an alternative side view of a hand rest for use while exercising the extensors.

FIG. 7*b* shows a hand rest for use in connection with the extensor or upwards exercises. Hand rest 700 includes an adjustable velcro strap 720 which extends over the top of hand 110.

Figure 7C:
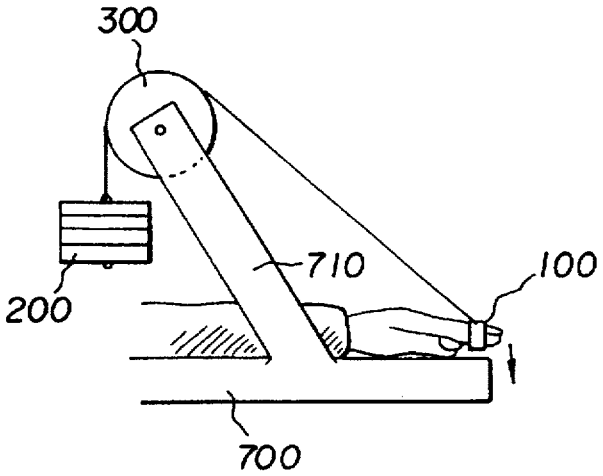
FIG. 7*c* illustrates an alternative side view of a hand rest for use while exercising the flexors.

While the exercises have been disclosed generally as inserting the finger through the sling having the finger through the sling having the finger pointing towards the weight, the finger may also be inserted through the sling away from the weight, as shown in FIG. 7*c*. The support member 710 and is positioned adjacent the user's arm such that the weight 200 does not touch the forearm. This allows the flexors to be exercised with the weight up and behind the hand.

Figure 7D:
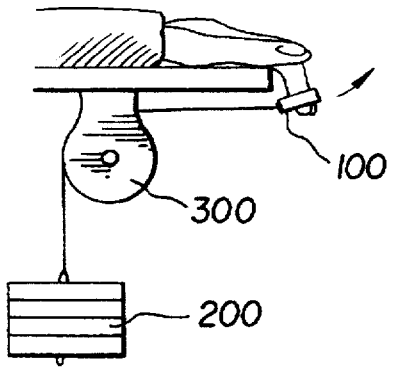
FIG. 7*d* illustrates a side view of an alternative configuration for exercising the extensors.

An additional configuration for performing extensor exercises is shown in FIG. 7*d*. Weights 200 are situated under the forearm and movement of the finger being exercised is from the bent position to a straight position.

Figure 8:
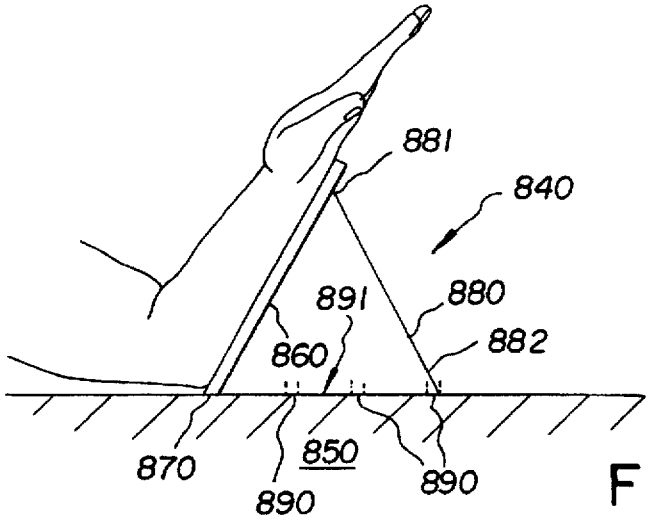
FIG. 8 illustrates a side view of a forearm support.

FIG. 8 shows a side view of a forearm support 840 which is used in a preferred embodiment of the invention. The forearm support 840 should be moveable from a position in which the forearm is in a completely upright, vertical position with respect to a table 850 or other flat surface on which the exercise is being performed to a position in which the forearm is in a horizontal position. Thus, in a preferred embodiment, the forearm support is a plank 860 attached at one end to a base 891 by a hinged connection 870. The plank 860 should typically have a sufficient length to extend from a user's elbow to his wrist. One end 881 of a bar 880 is attached by a hinge or other moveable connection member (not shown) near an opposite end of the plank 860. The base 891 further includes fixed grooves 890 or the like into which the free end 882 of the bar may be inserted to hold the plank 860 at a fixed angle with respect to the table 850. Other types of securing means for fixing the plank 860 at various angles may also be utilized.

In general, the most comfortable position for exercising the hand and finger muscles is with the forearm positioned at an angle ranging from 45 to 90 degrees with respect to a horizontal surface on which the elbow is resting. This minimizes any strain on the shoulder as well as the bicep or tricep muscles. Moreover, the finger and hand muscles may be comfortably exercised with the palm facing upward, downward or at any position therebetween without the need to restrain the hand or forearm by straps. To further minimize any strain to muscles other than the hand and finger muscles, it is desirable to hold the elbow as close to the body as possible.

Depending on the amount of weight being utilized, the distance at which the user positions his elbow with respect to his body and angle at which the user holds his forearm, the finger and hand muscles may be comfortably exercised without the use of a forearm support. Rather, the user may simply exercise without any support, or with an elbow support such as the elbow support cup 950 shown in FIG. 9*a*.

Figure 9A:
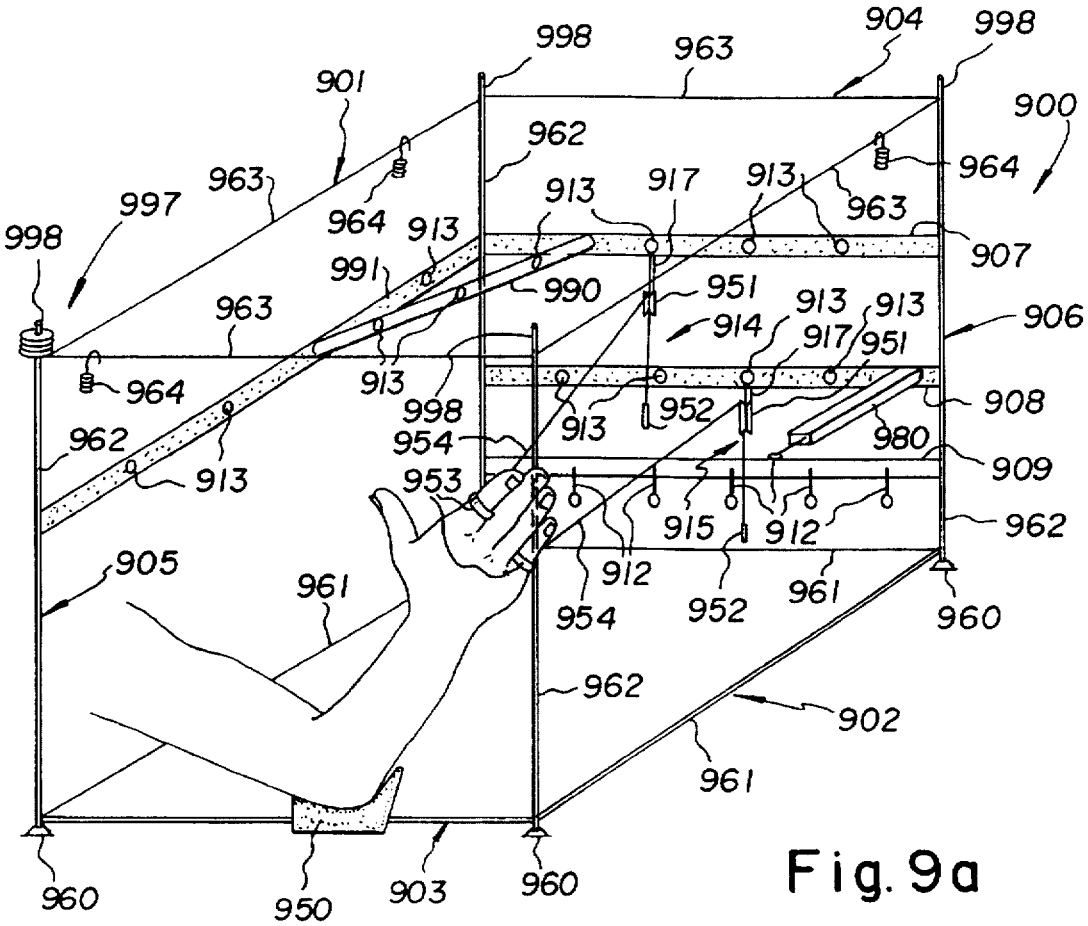
FIG. 9*a* illustrates a perspective view of a preferred embodiment in which the device includes a box-shaped frame having support members thereon for attachment of resistance means.

Referring more particularly to FIG. 9*a*, the elbow support cup 950 is shown as part of a preferred embodiment of the invention in which the device includes a box-shaped frame 900 which may be positioned on a table or other flat surface and into which a user's forearm is inserted for exercising the fingers and hand muscles. The box-shaped frame 900 forms a top 901, a bottom 902, a front 903, a back 904 and two sides 905, 906. The box-shaped frame 900 has a sufficient size to allow a forearm of a user to be completely inserted into the interior. Thus, at least the front 903 is open to receive the user's forearm, although in the preferred embodiment as shown, the box-shaped frame 900 is constructed of bars 961, 962, 963 such that the top 901, bottom 902, front 903, back 904 and sides 905, 906 are all open. The elbow support cup 950 as shown is positioned near the front 903 of the frame to allow the user to position his elbow close to his body. The preferred position of the user's hand is near the center of the box-shaped frame 900.

Of course, the device shown in FIG. 9*a* may also be used with a forearm support 840 or without any support. FIG. 9*c*, for example, shows a lower portion of a box-shaped frame in accordance with the invention in which the bottom 902' is solid (as opposed to the open configuration shown in FIG. 9*a*) and includes peg holes 970 at various locations. A support means 972 for supporting both the forearm and elbow includes a peg 971 which may be inserted into any one of the peg holes 970 for positioning the support means 972 at various locations within the box-shaped frame. In addition, the angle of the support means 972 with respect to the base 902 may be adjusted by inserting a rod 973 attached to the back of support means 972 into another of the peg holes 970.

The box-shaped frame 900 may be constructed using any suitable material such as wood, plastic or metal. Preferably, the material is light-weight. Moreover, it is desirable that the frame be easily disassembled (i.e., bars 961, 962, 963 should be completely separable from one another) or capble of folding down to a relatively flattened form so that it can be easily moved from one location to another. As shown in FIG. 9*a*, the box-shaped frame 900 may be secured to a table top using suction cups 960. Alternatively, it may be secured by using a C-clamp to hold down one or more of the lower bars 961 to the edges of the table or by either hanging weights 964 from the top bars 963 or mounting weights 997 on one or more corner posts 998.

The box-shaped frame 900 includes support members 907, 908, 909 positioned on the back 904. Each support member 907, 908, 909 includes multiple connections for attachment of resistance members 914, 915, each of which includes corresponding attachment means. Numerous configurations are available for the connections and attachment means. Support members 907 and 908, for example, include holes 913 into which a corresponding hooks 917 on resistance members 914, 915 are inserted. By contrast, support member 909 includes eyelets 912 into which hooks may also be inserted.

Various configurations are also available for the support members. For example, the support members 907, 908, 909 on the back 904 are substantially parallel to each other and to the bottom 902. Because each of these support members 907, 908 includes multiple connections (holes 913), the resistance members 914, 915 may be both vertically and horizontally separated, thus allowing each individual user to position the resistance members 914, 915 in the manner most comfortable to him or her depending upon the nature of the exercise being performed and the positioning of the hand and forearm. The user shown, for example, is exercising with the palm angled toward the side 905, back 904 and bottom 902. Preferably, the resistance members 914, 915 include swivel-type pulleys 951, as described above in connection with FIGS. 3*a* and 4*a*, interposed between the weights 952 and finger engaging elements 953. By using swivel-type pulleys 951 with the resistance members 914, 915 positioned as shown in FIG. 9*a*, the hand may also be rotated to a position with the palm facing downward without the adjacent resistance members 914, 915 interfering with one another, i.e., by cables 954 crossing.

Support members may be mounted on the top 901, bottom 902, front 903, back 904 and two sides 905, 906, as well as on each other. For example, support member 990 is mounted on support members 907 and 991. Support member 980 is mounted on support member 908 such that it extends perpendicularly outward therefrom. In this latter configuration, shown more clearly in FIG. 9*d* which is a right side view of the box-shaped frame 900 shown in FIG. 9*a*, support member 980 is mounted by inserting peg 982 at one end thereof through hole 913 in support member 908. Alternative mounting means may, of course, be utilized. The user's hand has been moved from the position shown in FIG. 9*a* such that it is placed directly over the resistance means 995. The user is now able to perform a different exercise, i.e., pulling weight 996 vertically upward.

Figure 9B:
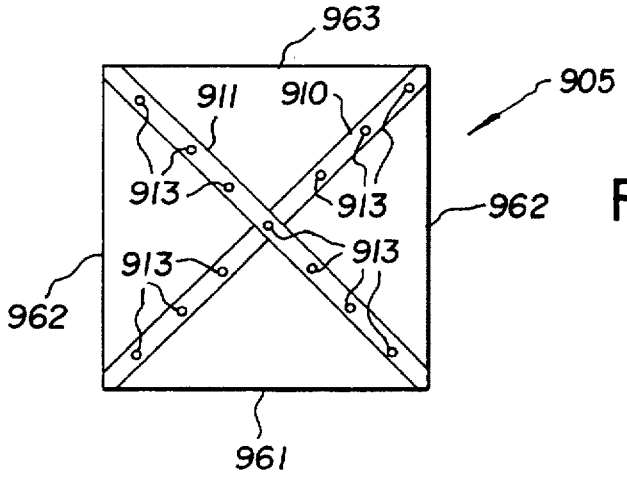
FIG. 9*b* shows an alternative configuration for the support members in the box-shaped frame shown in FIG. 9*a;*
Figure 9C:
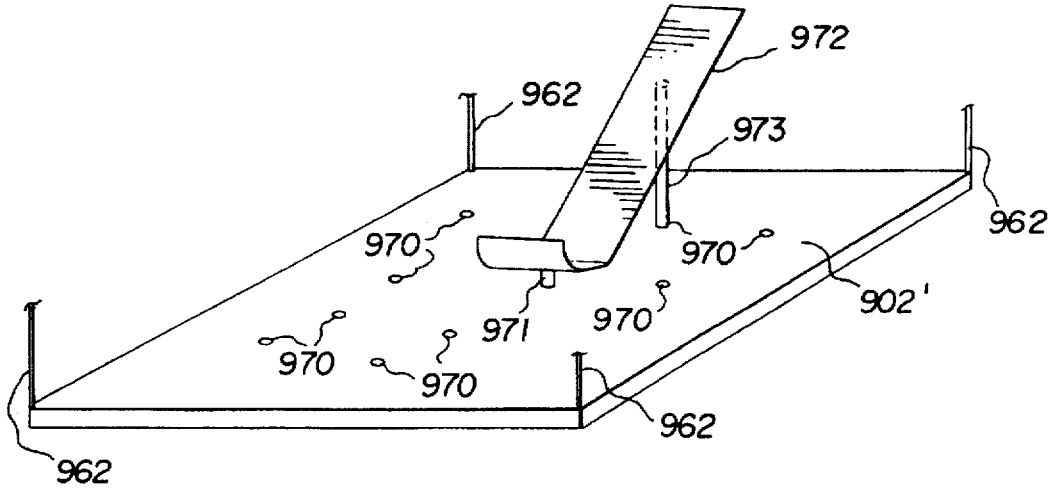
FIG. 9*c* shows a perspective view of an alternative configuration for a lower portion of the box-shaped frame in FIG. 9*a* in which the bottom is solid.
Figure 9D:
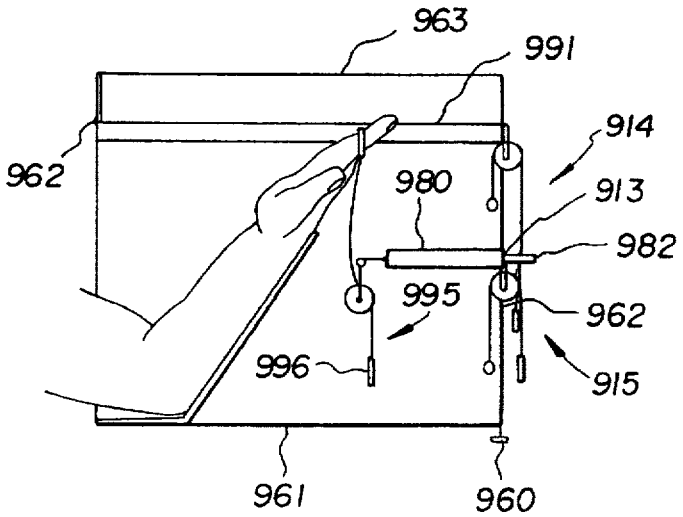
FIG. 9*d* shows a right side view of the box-shaped frame shown in FIG. 9*a* but with the user's arm preforming a different exercise using a different resistance means.

FIG. 9*b* shows an alternative configuration for the support members. A single diagonal support member 910 may be used to provide multiple connections (holes 913) positioned at different vertical and horizontal positions with respect to one another. Further, additional parallel diagonal members (not shown) or a second diagonal support member 911 positioned perpendicular to diagonal support member 910 may be used for attachment of resistance members.

The hand rests 700 and attachment rods 710 shown in FIGS. 7*a–d* could also be mounted on the support members or on the bottom 902 using pegs or other means.

There are different exercises which may be performed using the device of the present invention. The particular exercises will depend on the task for which a given user is attempting to strengthen the muscles. Particular tasks which may be simulated using the device of the invention include the playing of musical instruments, typing, knitting and general rehabilitation. The device is also useful for developing coordination skills in children. In addition to the extension and flexion movements stressed in conjunction with the figures, inserting a finger other than the thumb into the sling will allow adduction or abduction movements to be performed. When using a multiple pulley device, the pulleys may be positioned off of the straight ahead position of the fingers to exercise the muscles that provide abduction and adduction at the same time as flexion or extension. The thumb may be advantageously exercised using the configuration shown in FIG. 2*b*, with the thumb nail facing the weight, or with a configuration shown in FIG. 3*a* with cable 310 and sling 100 being nearly vertical and the thumb is nearly parallel with weight 200, and moving the thumb laterally as well as towards the other fingertips for classic opposition.

Although the present invention has been described above relative to exemplary preferred embodiments thereof, it will be understood by those skilled in the art that variations and modifications can be effected in these embodiments without departing from the scope and spirit of the invention as defined in the claims which follows.

I claim:

1. A device for training hand and finger muscles comprising:

a plurality of resistance members, each including:

(a) a weight for providing a fixed resistance, (b) a cable or rope having a first end attached to said weight, and (c) a finger engaging element attached to a second end of said cable or rope for moving said weight in response to movement of a finger therein, said finger engaging element being positionable at any point along a length of a finger;

a box-shaped frame comprising a top, a bottom, a front, a back and two sides, at least said front being open whereby a forearm of a user is completely insertable into an interior portion of said frame, said frame including at least one back support member positioned on each of said sides, each of said back and side support members having multiple connection points thereon at varying horizontal or vertical positions with respect to one another;

a plurality of attachment means for removably attaching said resistance members to said multiple connections at varying horizontal and vertical positions with respect to one another for allowing a user to individually exercise all fingers on one hand in a position in which respective palm of a user is facing upward, downward or at any position therebetween such that said resistance members do not interfere with one another; and support means positioned inside said box-shaped frame for supporting a forearm of a user substantially completely inside said box-shaped frame in at least one position ranging from a 45 to a 90 degree angle with respect to a surface on which said frame is positioned.

2. The device according to claim 1 wherein said support means comprises a plank hingedly attached to said bottom of said frame, said plank including securing means for fixing said support means in said position.

3. The device according to claim 1 wherein said support means comprises a cup-like element attachable to said bottom of said frame for supporting a user's elbow.

4. The device according to claim 3, wherein said cup-like element is positioned near the front of said frame.

5. The device according to claim 1 comprising at least two back support members or two side support members having multiple connection points thereon for attachment of said resistance members, said two support members being parallel with respect to one another.

6. The device according to claim 5 wherein at least one of said back or side support members is positioned at an angle between 0 and 90 degrees with respect to the bottom.

7. The device according to claim 1 further comprising at least one top support member positioned on said top, said top support member including multiple connections at varying horizontal or vertical positions with respect to one another.

8. The device according to claim 1 wherein said multiple connection points comprise one of hooks or eyelets and said attachment means comprise the other of hooks or eyelets.

9. The device according to claim 1 wherein said box-shaped frame comprises a cube.

10. The device according to claim 1 wherein said attachment means comprise pulleys interposed between said weight means and said finger engaging element.

11. The device according to claim 10 wherein each of said pulleys includes swivel means for allowing fingers of a user to individually exercise in a position in which a respective palm of a user is facing upward, downward or at any position therebetween such that said resistance members do not interfere with one another during rotation of a user's wrist.

12. The device according to claim 1 wherein said finger engaging element comprises a sling.

13. The device according to claim 1 wherein said support means is securable to the bottom of said box-shaped frame for supporting a forearm of a user inside said box-shaped frame during training of a user's hand and finger muscles.

* * * * *